US005520451A

United States Patent [19]

Oshima

[11] Patent Number: 5,520,451

[45] Date of Patent: May 28, 1996

[54] GUIDE DEVICE FOR FLIPPER DOOR IN CABINET

[75] Inventor: Kazuyoshi Oshima, Tokyo, Japan

[73] Assignee: Sugatsune Kogyo Co., Ltd., Tokyo, Japan

[21] Appl. No.: 364,937

[22] Filed: Dec. 28, 1994

[30] Foreign Application Priority Data

Dec. 29, 1993 [JP] Japan ..... 5-075972 U

[51] Int. Cl.[6] ..... A47B 88/00

[52] U.S. Cl. ..... 312/322; 312/110; 312/331; 312/334.8; 49/254; 49/258

[58] Field of Search ..... 312/322, 331, 312/110, 334.8; 49/254, 258; 384/58, 19, 21, 22

[56] References Cited

U.S. PATENT DOCUMENTS

| | | | |
|---|---|---|---|
| 2,669,499 | 2/1954 | Vanderplank | 312/322 |
| 2,936,206 | 5/1960 | Wilmer et al. | 312/322 |
| 3,456,995 | 7/1969 | Nyquist | 312/322 |
| 3,794,401 | 2/1974 | Dean et al. | 312/110 X |
| 4,186,972 | 2/1980 | Hagen | 312/110 X |
| 4,641,896 | 2/1987 | Iimura et al. | 312/110 |
| 4,729,612 | 3/1988 | Stone | 312/322 X |
| 4,815,797 | 3/1989 | Haab et al. | 312/322 |
| 4,852,212 | 8/1989 | Amann | 312/322 X |
| 4,910,916 | 3/1990 | Dubach et al. . | |
| 4,974,912 | 12/1990 | Rask et al. | 312/322 X |
| 4,976,502 | 12/1990 | Kelley et al. | 312/322 X |
| 5,083,847 | 1/1992 | Peters | 312/322 |
| 5,108,165 | 4/1992 | Rorke et al. | 312/322 |
| 5,121,976 | 6/1992 | Haab et al. | 312/322 |
| 5,149,180 | 9/1992 | Haab et al. | 312/322 |
| 5,323,569 | 1/1994 | Walz | 312/322 X |
| 5,395,165 | 3/1995 | Woerner | 312/110 |
| 5,399,010 | 3/1995 | McClung et al. | 312/322 X |

FOREIGN PATENT DOCUMENTS

| | | | |
|---|---|---|---|
| 1191187 | 7/1985 | Canada | 312/331 |

*Primary Examiner*—Peter M. Cuomo
*Assistant Examiner*—Rodney B. White
*Attorney, Agent, or Firm*—Evenson, McKeown, Edwards & Lenahan

[57] ABSTRACT

A disclosed guide device for a flipper door includes a pair of main rails disposed in a cabinet body, a pair of auxiliary rails slidably supported respectively on the pair of main rails, and a pair of sliders slidably supported respectively on the pair of auxiliary rails. Two corner portions of the flipper door are rotatably supported on the pair of sliders, respectively. The guide device further includes an association mechanism for associating the auxiliary rails with the sliders respectively. The auxiliary rails and the sliders thus associated with each other by the association mechanism are slid along the main rails together, respectively. The association mechanism removes the association between the auxiliary rails and the sliders when the auxiliary rails have reached substantially innermost end portions of the main rails, respectively. By this, the sliders are allowed to slide inwardly of the cabinet body along the auxiliary rails.

4 Claims, 10 Drawing Sheets

GUIDE DEVICE FOR FLIPPER DOOR IN CABINET

BACKGROUND OF THE INVENTION

This invention relates to a device for guiding a flipper door which is adapted to open and close an opening of a cabinet.

A guide device for a flipper door includes a pair of horizontal rails mounted on an inner surface of a cabinet body, and a pair of sliders slidably supported on the rails. Rotatably connected to the pair of sliders are two corners of the flipper door, which two corners are located on the upper side of the flipper door when the flipper door is in the closed position.

In the construction mentioned above, when the flipper door is in a vertical posture in the closed position, the pair of sliders are located at front ends of the rails, i.e., in the vicinity of a peripheral edge of an opening of a cabinet body. The flipper door is opened by being rotated ninety (90) degrees about the sliders. The opened flipper door is pushed into the cabinet body in its horizontal posture. At that time, the pair of sliders are slid respectively along the pair of rails, thereby guiding the flipper door inwardly of the cabinet body.

During the time the flipper door is being guided inwardly of the cabinet body as mentioned, a rotational moment about a vertical axis is sometimes applied to the flipper door. Due to this rotational moment, the sliders contact hard the rails in a direction perpendicular to the rails. As a result, a frictional resistance is generated, and this gives rise to a problem that the flipper door cannot move smoothly.

In order to prevent an occurrence of such a problem as just mentioned, it can be contemplated that the length of the sliders is increased in the longitudinal direction of the rails in order to lessen the frictional resistance between the sliders and the rails when the above-mentioned rotational moment is generated. However, if the length of the sliders is increased, the flipper cannot move sufficiently far into the cabinet body and as a result, the flipper is partly and greatly projected outwardly of the cabinet body.

In order to lessen the frictional resistance, it can be contemplated that a long plate is disposed between a pair of sliders as disclosed in U.S. Pat. No. 4,910,916. However, this also requires long sliders in order to mount the plate on the sliders and the flipper door cannot move sufficiently far into the cabinet body.

SUMMARY OF THE INVENTION

It is, therefore, an object of the present invention to provide a guide device, by which a flipper door can be smoothly guided inwardly of a cabinet body, and the flipper door can be received sufficiently far into the cabinet body.

According to the present invention, there is provided a guiding device for guiding a flipper door in a cabinet which includes a cabinet body having a front opening and the flipper door for opening and closing the front opening, the guiding device comprising:

(a) a pair of main rails disposed on the cabinet body, the main rails being in a spaced parallel relation with each other and extending inwardly of the cabinet body generally from a peripheral edge of the front opening;

(b) a pair of auxiliary rails slidably supported respectively on the pair of main rails, the auxiliary rails extending in the same direction as the main rails but shorter in length than the main rails;

(c) a pair of sliders slidably supported respectively on the pair of auxiliary rails, the sliders being shorter in length in a sliding direction thereof than the auxiliary rails, two corner portions of the flipper door being rotatably supported respectively on the pair of sliders; and (d) association means for associating the auxiliary rails with corresponding the sliders when the flipper door in an open position is pushed inwardly of the cabinet body along the main rails, so as to be prohibited from sliding relative to the auxiliary rails, thereby allowing the auxiliary rails and sliders to be slid along the main rails together;

(e) the association means removing the association between the auxiliary rails and the sliders when the auxiliary rails have reached substantially innermost end portions of the main rails, respectively, thereby enabling the sliders to slide inwardly of the cabinet body along the auxiliary rails.

DETAILED DESCRIPTION OF THE EMBODIMENT

Figure 1A:
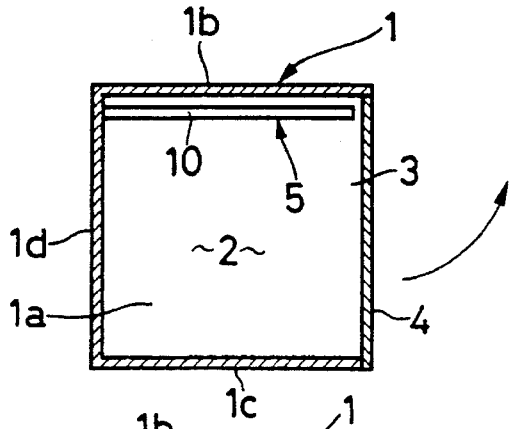
FIG. 1A is a side sectional view of a cabinet having a guide device, according to the present invention, showing a state in which a flipper door is in a closed position.

The present invention will now be described with reference to the accompanying drawings. Referring first to FIGS.

1A, 1B, 2A and 2B, a general construction of a cabinet incorporated with the present invention will be described. The cabinet comprises a cabinet body 1, a flipper door 4, and a guide device 5 for guiding the flipper door 4. The cabinet body 1 is formed into a three-dimensional configuration by a pair of opposite side plates 1*a*, a top plate 1*b*, a bottom plate 1*c*, and a back plate 1*d*. The cabinet body 1 has as inner space 2 surrounded with the plates 1*l* to 1*d*, and a front opening 3. The flipper door 4 is operated to open and close the front opening 3 of the cabinet body 1. In these Figures, the guide device 5 is illustrated in its simplified form, and only a pair of main rails 10 are shown which are disposed at upper parts of inner surfaces of the side plates 1*a*, respectively.

Figure 1B:
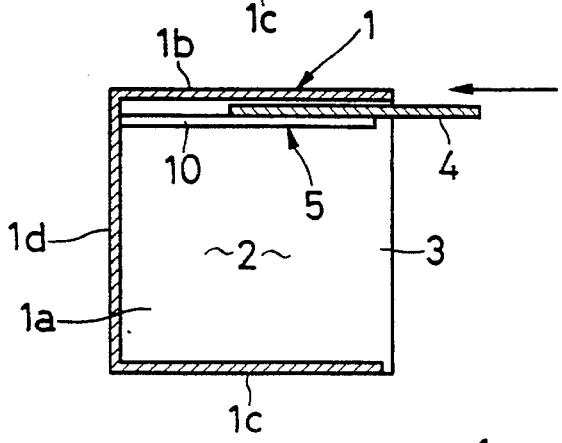
FIG. 1B is likewise a side sectional view of the cabinet of FIG. 1A, but showing a state in which the flipper door in an open position is in a midway to be received in a cabinet body.
Figure 2A:
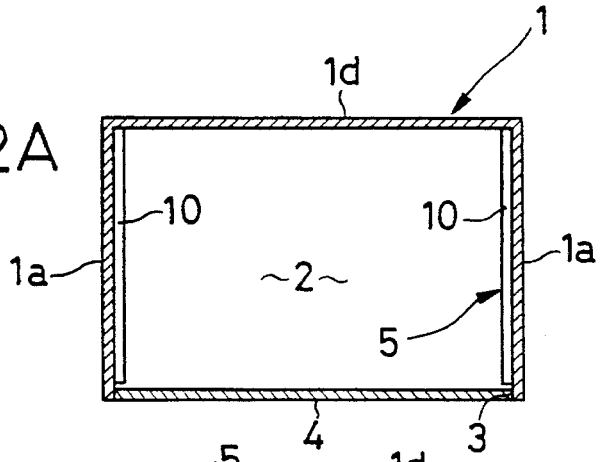
FIG. 2A is a plan sectional view of the cabinet, but showing a state in which the flipper door is in the closed position.
Figure 2B:
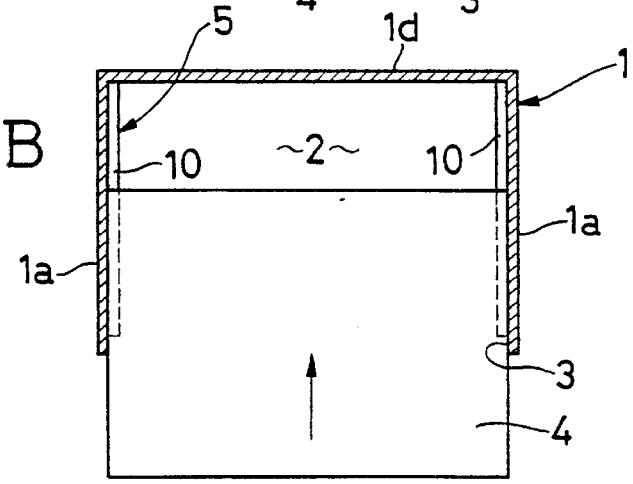
FIG. 2B is likewise a plan sectional view of the cabinet, but showing a state in which the flipper door in the open position is in a midway to be received in the cabinet body.

As shown in FIGS. 1A and 2A, the flipper door 4 in its vertical posture closes the front opening 3 of the cabinet body 1. The flipper door 4 is rotated ninety (90) degrees to take its horizontal posture. In the horizontal state, as shown in FIGS. 1B and 2B, the flipper door 4 is pushed into the cabinet body 1 and received in the inner space 2 of the cabinet body 1. When the flipper door 4 is moved inwardly of the cabinet body 1, it is guided by the guide device 5.

Next, a construction of the guide device 5 will be described in great detail with reference chiefly to FIGS. 3 through 6, and FIG. 9. The guide device 5 includes the pair of main rails 10, a pair of auxiliary rails 20 slidably supported respectively on the main rails 10, and a pair of sliders 40 slidably supported respectively on the auxiliary rails 20 and rotatably supporting thereon the flipper door 4. It should be noted that although FIGS. 3 through 6 and FIG. 9 show only component parts of the left half (when viewed from the front of the cabinet 1) of the guide device 5, the components parts of the right half are exactly the same as the left half.

Figure 3:
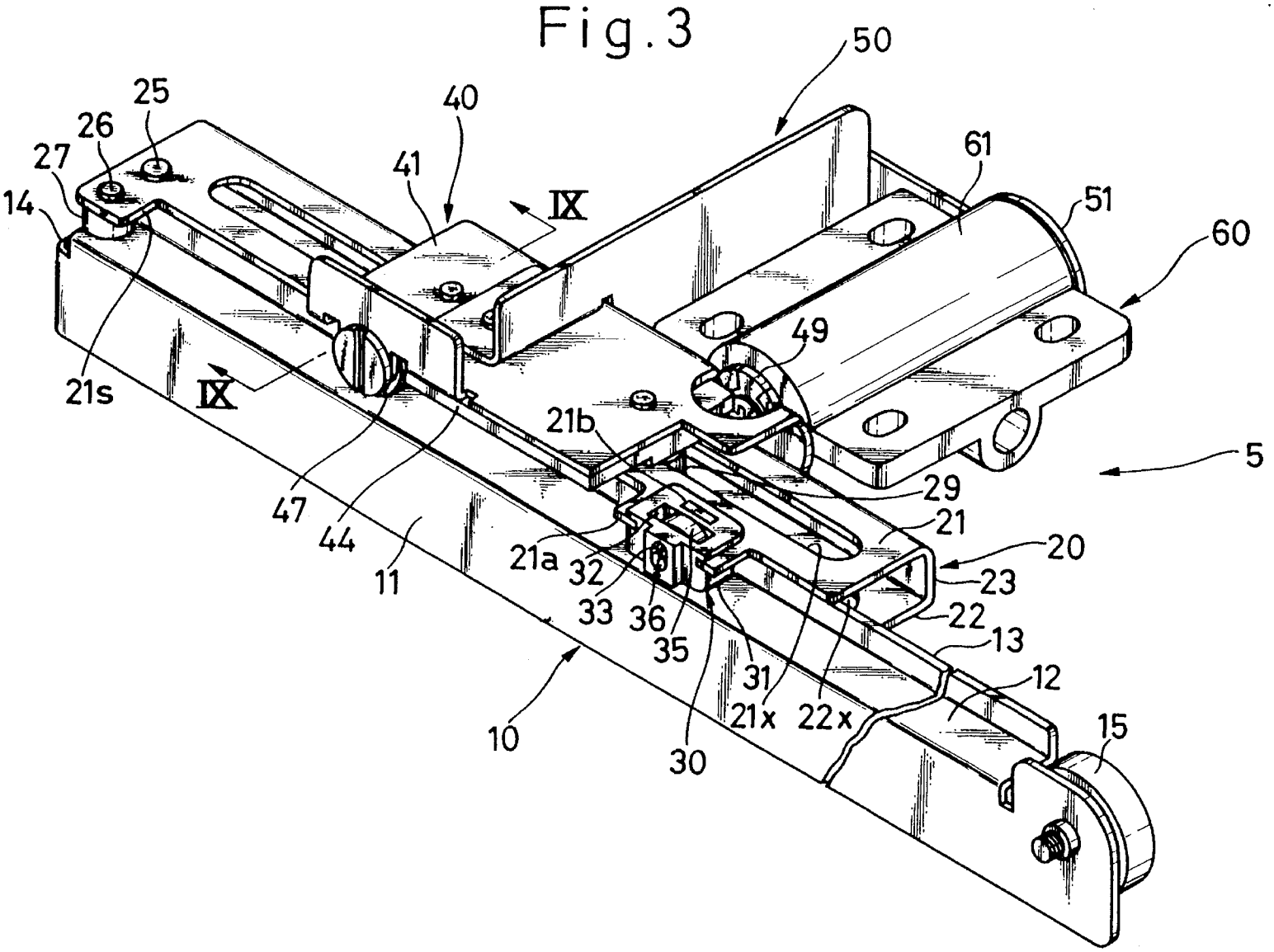
FIG. 3 is a perspective view showing the guide device.
Figure 4:
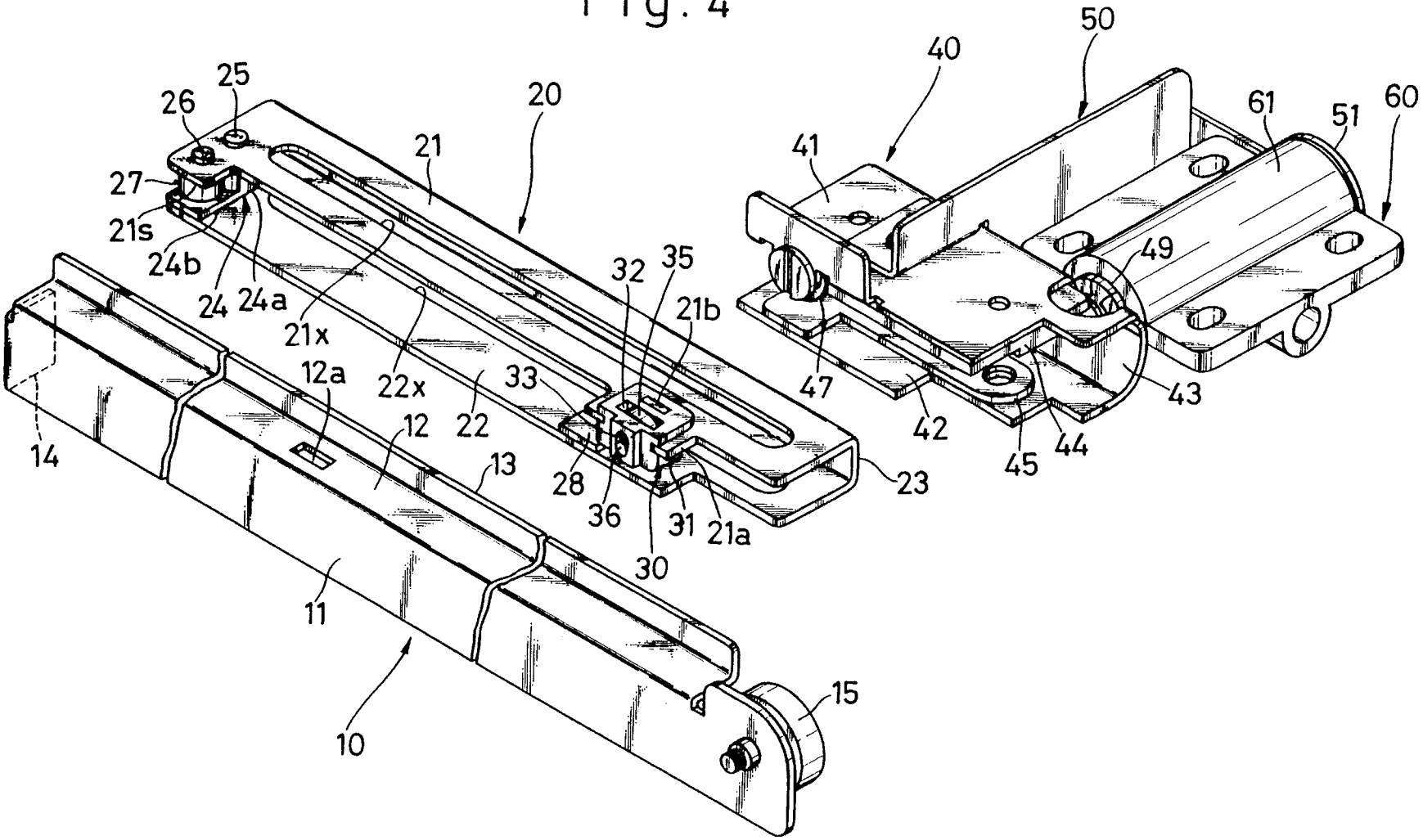
FIG. 4 is a perspective view of the guide device, but showing a state in which the guide device is exploded into a main rail, an auxiliary rail, and a slider.

As shown in FIGS. 1 and 2, the pair of main rails 10 are mounted respectively on inner surfaces of upper parts of the opposite side plates 1*a* of the cabinet body 1 through brackets not shown and allowed to extend horizontally in a longitudinal direction of the cabinet body 1. As shown in FIGS. 3 and 4, the main rail 10 includes a base wall 11 parallel with the side plate 1*a* of the cabinet body 1, a horizontal wall 12 extending from an upper edge of the base wall 11 in a direction away from the side plate 1*a* and perpendicular to the base wall 11, and an upstanding wall 13 vertically upstanding from a leading edge of the horizontal wall 12. A rear end of the base wall 11 is bent at right angles and this bent portion is served as a stopper 14. This stopper 14 is in a location proximate to an inner surface of the back plate 1*d* of the cabinet body 1. A pitfall 12*a* is formed in the horizontal wall 12 at an area a predetermined distance away from a rear end of the horizontal wall 12. A support roller 15 is rotatably supported on a front end portion of the base wall 11. This support roller 15 projects upwardly of an upper edge of the upstanding wall 13. This support roller 15 is located at one of the two upper corners of the opening 3 of the cabinet body 1. Another support roller, not shown, is located at the other upper corner of the opening 3.

Figure 5:
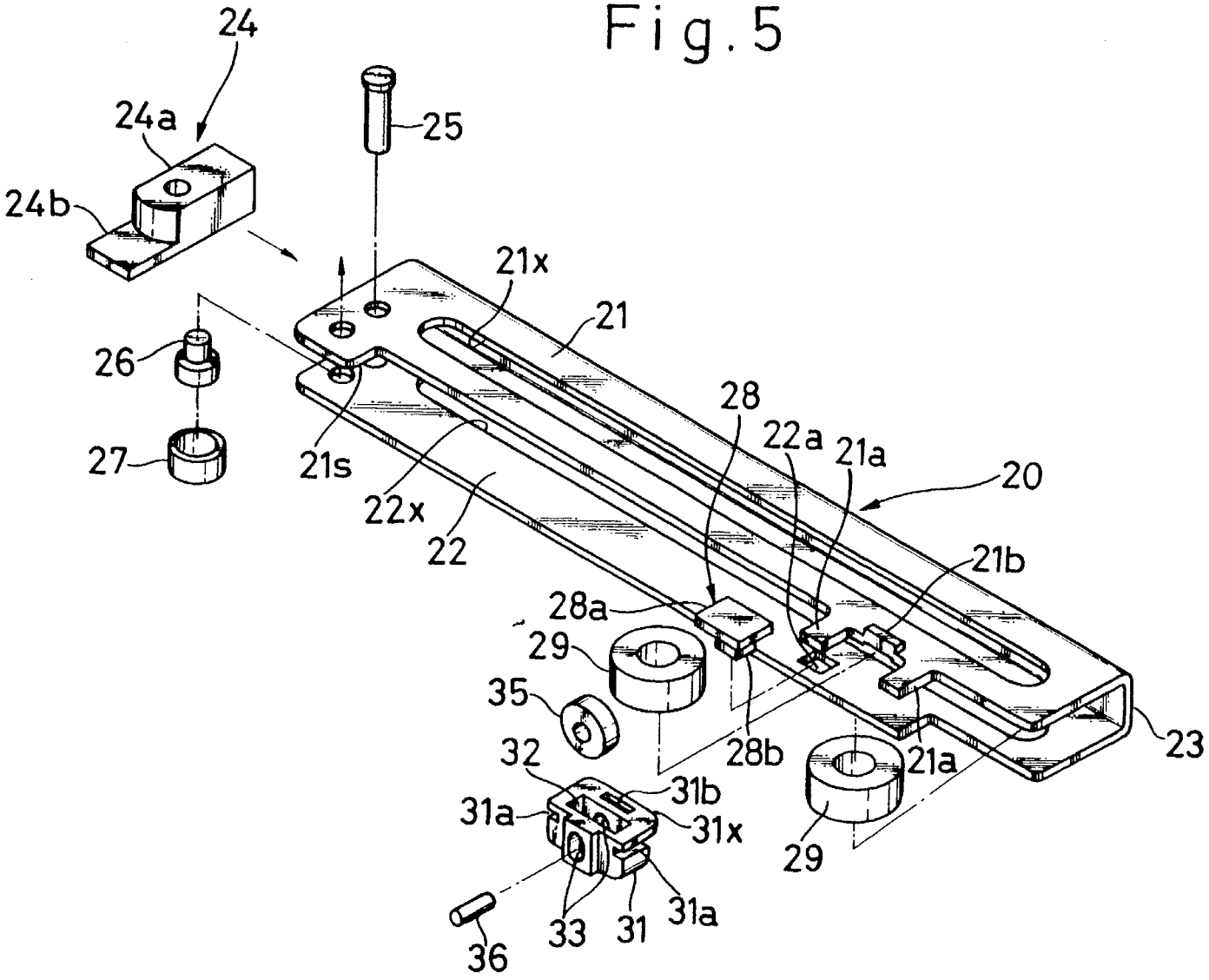
FIG. 5 is a perspective view, showing an exploded state of the auxiliary rail and accessories thereof.

As shown in FIGS. 3 through 5, the auxiliary rail 20 is shorter in length than the main rail. 10. For example, the auxiliary rail 20 has the length about ½ to ¼ of that of main rail 10. The auxiliary rail 20 includes an upper horizontal wall 21, a lower horizontal wall 22, and a vertical wall 23 connecting the upper and lower horizontal walls 21 and 22 together. The auxiliary rail 20 has a horizontal U-shaped configuration in section.

Mounted on a rear end portion of the auxiliary rail 20 is a guide block 24 which is formed of resin of a small frictional resistance. This guide block 24 includes a thick base portion 24*a*, and a thin extension portion 24*b* extending from a lower end of the base portion 24*a* toward the side plate 1*a* of the cabinet body 1. The guide block 24 is received in the rear end portion of the auxiliary rail 20 and fixed by a fixing pin 25. In that fixed state, the base portion 24*a* of the guide block 24 is spacelessly received between the horizontal walls 21 and 22 of the auxiliary rail 20 with the extension portion 24*b* being in contact with the lower horizontal wall 22.

Formed on the rear end portion of the upper horizontal wall 21 is a stopper 21*s* projecting horizontally toward the side wall 1*a*. A support pin 26 is fixed to the stopper 21*s*, and a guide ring 27, which is formed of resin of a small frictional resistance, is attached to an enlarged lower end portion of the support pin 26. A side surface of this guide ring 27 is horizontally opposite to the base portion 24*a* of the guide block 24 with a space therebetween. A lower end surface of the guide ring 26 is vertically opposite to the extension portion 24*b* of the guide block 24 with a space therebetween.

Attached to the auxiliary rail 20 at an area in the vicinity of a front end thereof are a guide chip 28, and a guide block 31 as one of the component elements of an association mechanism 30 as later described. The guide block 31 and guide chip 28 are formed of resin of a small frictional resistance.

As best shown in FIG. 5, the guide chip 28 includes a flat base portion 28*a*, and a projection 28*b* projecting downwardly from a lower surface of the base portion 28*a*. By this projection 28*b* being fitted in a hole 22*a* formed in the lower horizontal wall 22, the guide chip 28 is attached to the lower horizontal wall 22.

The guide block 31 is attached to the upper horizontal wall 21 in the following manner. That is, as best shown in FIG. 5, a pair of claws horizontally extending and spaced away from each other in the longitudinal direction of the auxiliary rail 20 are formed on the upper horizontal wall 21. A vertically extending claw 21*b* is formed between the pair of claws 21*a*. A groove 31*a* is formed in each side surface of the guide block 31. A hole 31*b* is formed in a flange 31*x* horizontally projecting from an upper end of the guide block 31. By fitting the pair of claws 21*a* into the pair of grooves 31*a* and the claw 21*b* into the hole 31*b* respectively, the guide block 31 is attached to the upper horizontal wall 21. A lower surface of the guide block 31 is away from the lower horizontal wall 22. The guide block 31 and guide chip 28 are arranged in such a manner as to be offset in the longitudinal direction of the auxiliary rail 20 and vertical away from each other with a space therebetween.

Guide slits 21*x* and 22*x* extending longitudinally of the auxiliary rail 20 are formed in the horizontal walls 21 and 22 of the auxiliary rail 20, respectively. The guide slits 21*x* and 22*x* are vertically opposite to each other. Two rollers 29 as later described can move along the guide slits 21*x* and 22*x*. The two guide rollers 29 and the above-mentioned guide block 31 are horizontally away from each other with a space therebetween.

The auxiliary rail 20 is supported on the main rail 10 in the following manner. The horizontal wall 12 and upstanding wall 13 are inserted between the horizontal walls 21 and 22 of the auxiliary rail 20. The horizontal wall 12 of the main rail 10 is slightly loosely inserted in the space between the extension portion 24*b* of the guide block 24 and the guide ring 27 and also slightly loosely inserted in the space between the guide block 31 and the guide chip 28. Similarly, the upstanding wall 13 of the main rail 10 is slightly loosely inserted in the space between the base portion 24*a* of the guide block 24 and the guide ring 27, and also slightly loosely inserted in the space between the guide block 31 and the guide rollers 29. As a consequence, the auxiliary rail 20 extending in the same direction as the main rail 10 is supported on the main rail 10 for sliding only in the longitudinal direction of the main rail 10. And the auxiliary rail 20 is prohibited from moving in two directions (i.e., vertical and lateral directions) perpendicular to the longitudinal direction of the main rail 10.

Figure 6:
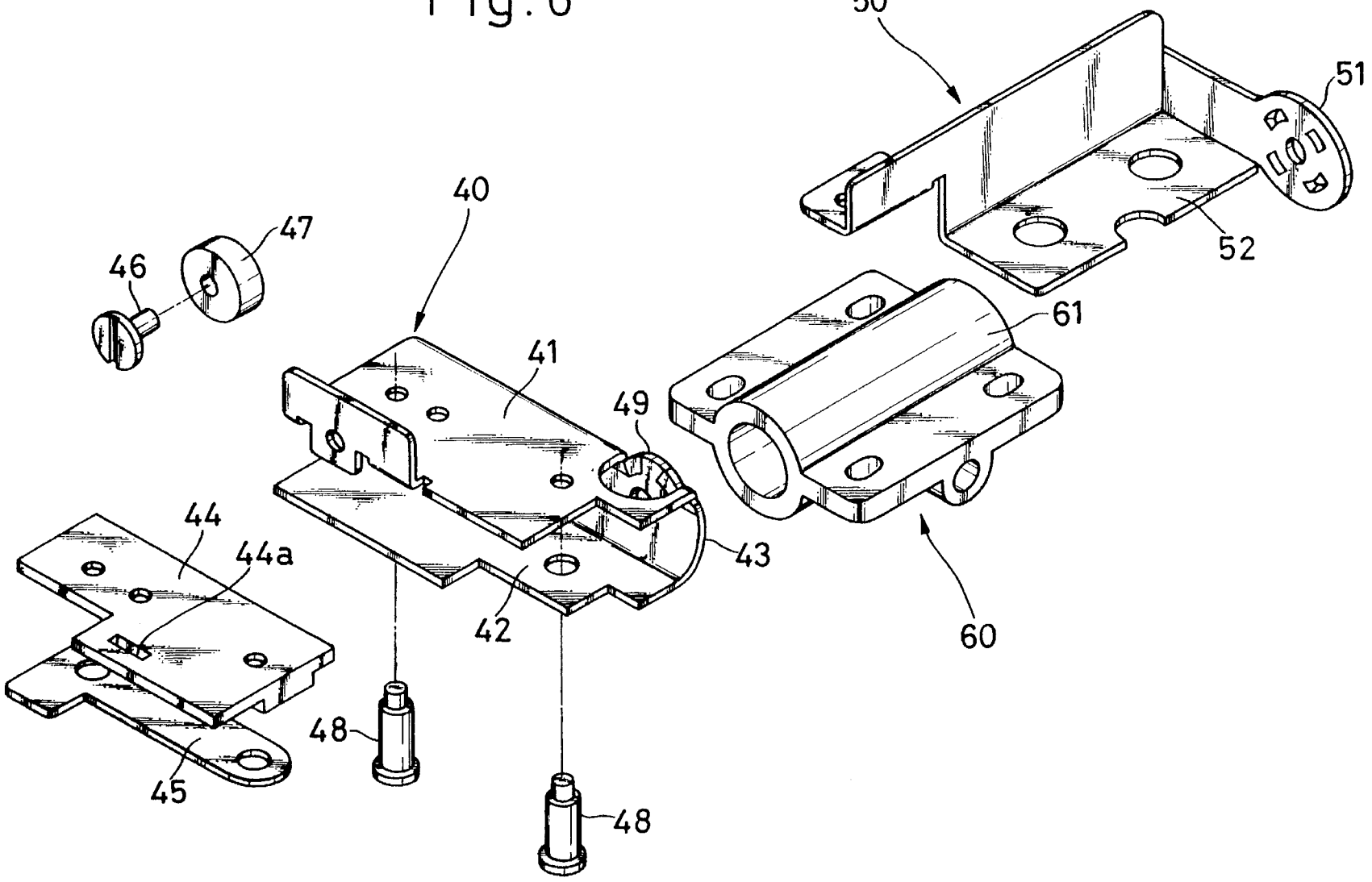
FIG. 6 is a perspective view, showing an exploded state of the slider and accessories thereof.

As shown in FIGS. 3, 4, and 6, the slider 40 includes an upper horizontal wall 41, a lower horizontal wall 42, and a vertical wall 43 connecting the upper and lower horizontal walls 41 and 42. The slider 40 has a horizontal U-shaped configuration in section. A guide plate 44 is attached to a lower surface of the upper horizontal surface 41, and another guide plate 45 is attached to an upper surface of the lower horizontal wall 42. The guide plates 44 and 45 are formed of resin of a small frictional resistance and served as a portion of the slider 40. With the auxiliary rail 20 inserted between the guide plates 44 and 45 and with the horizontal walls 21 and 22 of the auxiliary rail 20 contacting the guide plates 44 and 45 respectively, the slider 40 is slidably supported on the auxiliary rail 20.

A rear end portion of the upper horizontal wall 41 of the slider 40 is upwardly press-worked. A roller 47 is rotatably supported on this upwardly press-worked portion through a support pin 46. With the slider 40 supported on the auxiliary rail 20, the roller 47 is in contact with the upper surface of the horizontal wall 12 of the main rail 10.

As best shown in FIG. 6, two support pins 48 are attached to the auxiliary rail 20 in such a manner as to be longitudinally away from each other. The support pins 48 extends vertically with opposite ends thereof extending through the guide plates 44 and 45 and fixed to the horizontal walls 41 and 42, respectively. The support pins 48 are inserted in the guide slits 21*x* and 22*x* formed in the horizontal walls 21 and 22 of the auxiliary rail 20, respectively. Owing to this arrangement, the slider 20 is allowed to slide in the longitudinal direction of the auxiliary rail 20 but prohibited from moving in a direction (i.e., lateral direction) perpendicular to the longitudinal direction. On the support pins 48, the afore-mentioned guide rollers 29 are rotatably supported, respectively.

Next, the association mechanism 30 for associating the auxiliary rail 20 with the slider 40 will be described. This association mechanism 30 includes the guide block 31, and an engagement roller 35 (engagement member) supported by the guide block 31. More specifically, the guide block 31 has a receiving hole 32 vertically extending all the way therethrough. A vertically extending elongate hole 33 is formed in each of a pair of walls opposing to each other with the receiving hole 32 therebetween. A shaft 36 extending through the center of the engagement roller 35 is fixed to the engagement roller 35. The engagement roller 35 is received in the receiving hole 32 of the guide block 31, and opposite end portions of the shaft 36 are received in the pair of elongate holes 33, respectively. As a consequence, the engagement roller 35 is vertically movably supported by the guide block 31. With the engagement roller 35 loaded on the upper surface of the horizontal wall 12 of the main rail 10, an upper portion of the roller 35 protects upwardly of the upper surface of the guide block 31. When the engagement roller 35 is fallen into the pitfall 12*a* formed in the horizontal wall 12, the upper portion of the engagement roller 35 is brought to a level either equal to or lower than the upper surface of the guide block 31.

As shown in FIG. 6, an engagement hole 44*a* is formed in the guide plate 44. With the engagement roller 35 of the association mechanism 30 loaded on the upper surface of the main rail 10 and with the upper portion of the engagement roller 35 projecting upwardly of the upper surface of the guide block 31, the upper portion of the engagement roller 35 is fitted in the engagement hole 44*a*, thereby associating the auxiliary rail 20 with the slider 40. When the engagement roller 35 falls in the pitfall 12*a*, the engagement roller 35 is disengaged from the engagement hole 44*a* to remove the association between the auxiliary rail 20 and the slider 40.

A bracket 50 is fixed to the upper horizontal wall 41 of the slider 40. A support portion 49 is formed at a front end portion of the vertical wall 43 of the slider 40. A support portion 51 is formed at the bracket 50 in such a manner as to be spacedly opposite to the support portion 49. A shaft (not shown) with opposite ends thereof fixed to the support portions 49 and 51 is inserted in a cylindrical portion 61 of an attachment 60. Owing to this arrangement, the attachment 60 is rotatably connected to the slider 40 and bracket 50.

Two corner portions (corner portions located on the upper side when the flipper door 4 is in the closed position) of the flipper door 4 are fixed to a pair of the attachments 60 of the guide device 5, respectively. A horizontal wall 52 is formed on the bracket 50. When the attachment 60 contacts the horizontal wall 52, the flipper door 4 is brought into its horizontal posture.

Figure 7A:
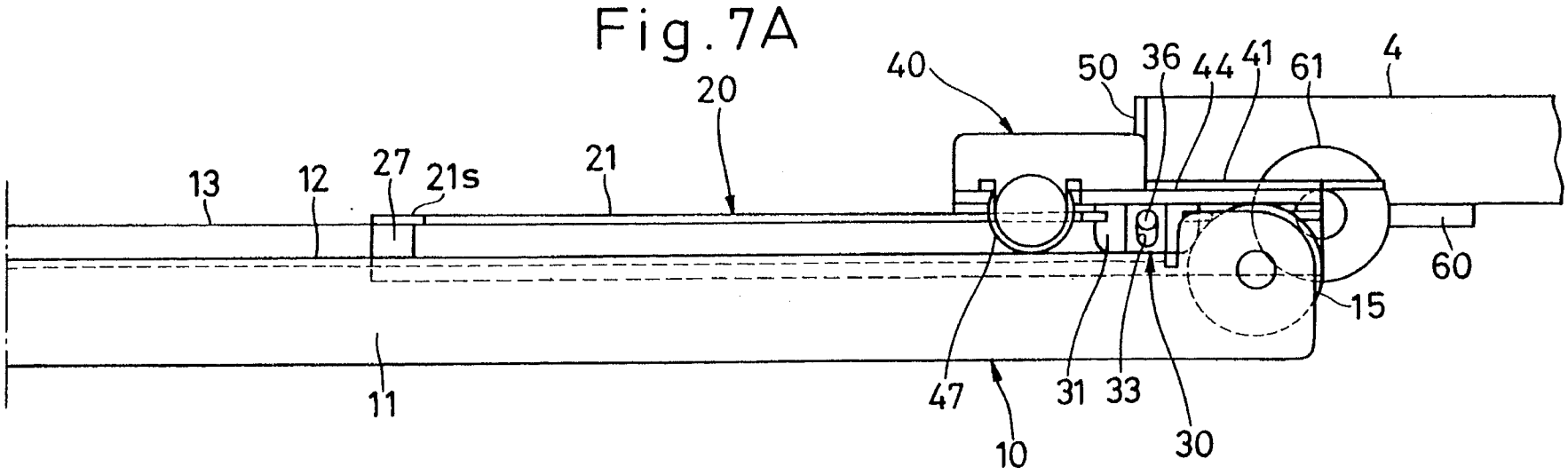
FIGS. 7A through 7D are side views of the guide device, showing several states of the guide device during the course of the flipper door being received in the cabinet body.

In the construction mentioned above, by rotating the flipper door 4 in its vertical posture ninety (90) degrees, the front opening 3 of the cabinet body 1 is opened. As a consequence, as shown in FIG. 7A, the flipper door 4 is brought into its horizontal posture. In that state, the auxiliary rail 20 and slider 40 are located at the front end portion of the main rail 10.

Figure 7B:
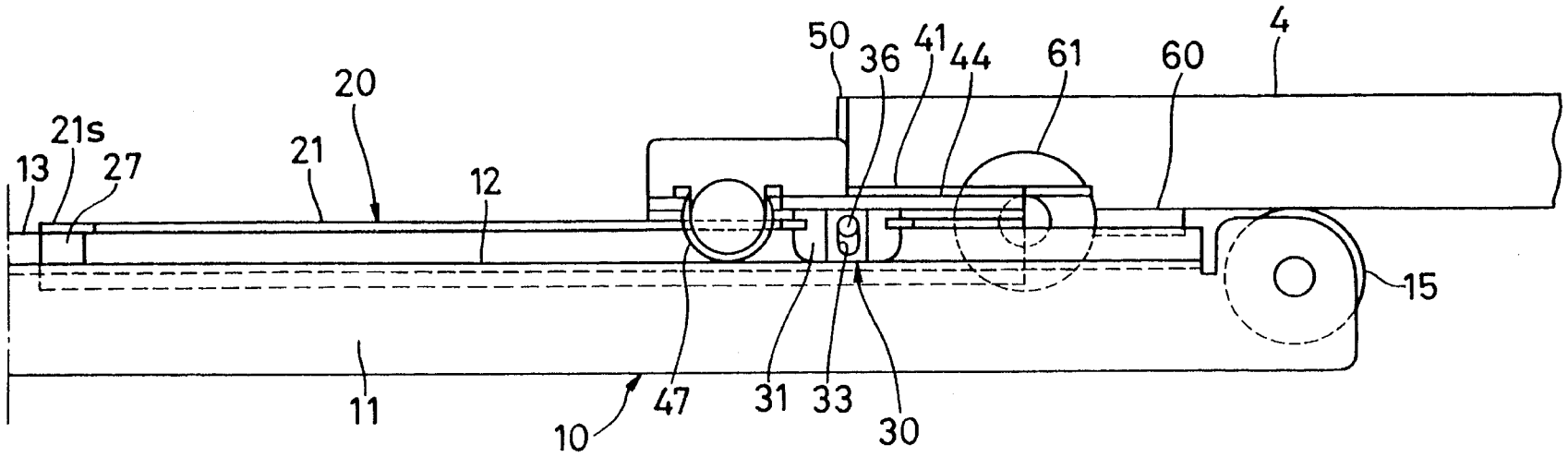
Figure 8A:
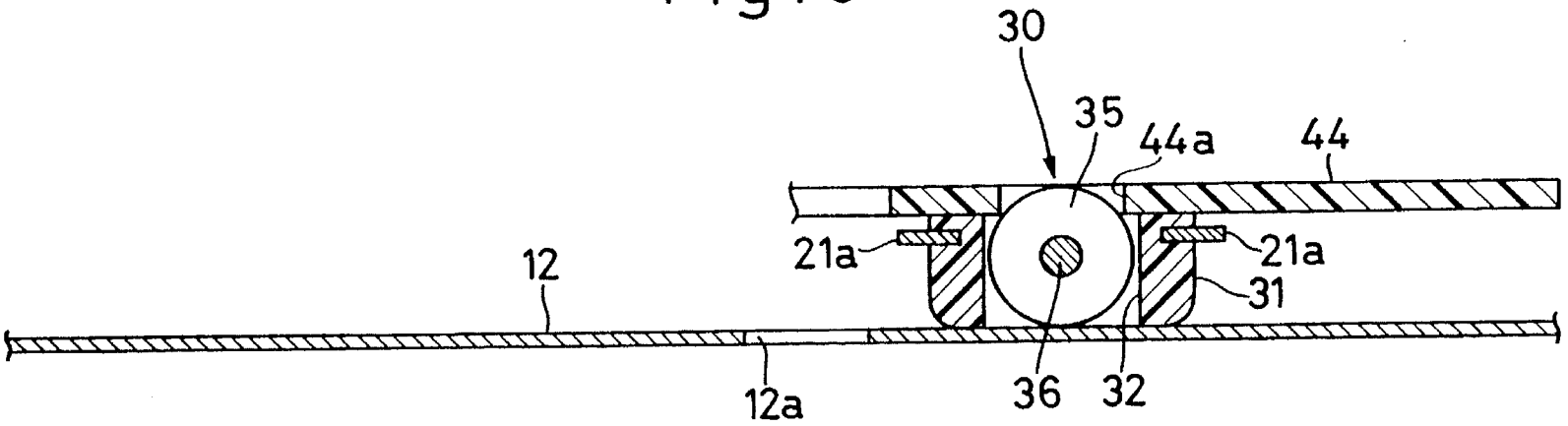
FIGS. 8A and 8B are enlarged sectional views of an association mechanism of the guide device, showing states of the association mechanism during the course of the flipper door being received in the cabinet body.

The flipper door 4 in its horizontal posture is pushed into the inner space 2 of the cabinet body 1. A pushing force applied to the flipper door 4 is transmitted to the slider 40. As shown in FIG. 8A, since the engagement roller 35 of the association mechanism 30 is loaded on the upper surface of the horizontal wall 12 of the main rail 10 and the upper portion of the engagement roller 35 is inserted in the engagement hole 44*a* of the slider 40, the slider 40 is associated with the auxiliary rail 20 so as to be prohibited from sliding relative to the auxiliary rail 20. As a consequence, the pushing force transmitted to the slider 40 is transmitted to the auxiliary rail 20 through the association mechanism 30, and as shown in FIG. 7B, the slider 40 and the auxiliary rail 20 are moved together along the main rail 10 to guide the flipper door 4 inwardly of the cabinet body 1. The guiding action at that time depends merely on the slide of the auxiliary rail 20 relative to the main rail 10. Since the auxiliary rail 20 is sufficiently long compared with the slider 40, the flipper door 4 is not greatly inclined rightwardly or leftwardly with respect to the sliding direction thereof. Also, even if a rotational moment about a vertical axis is applied to the flipper door 4, the auxiliary rail 20 lessens a contacting force to the main rail 10 in a direction perpendicular to the main rail 10. In other words, since the distance between contacting points of the guide block 24 and guide ring 27 with respect to the upstanding wall 13 of the main rail 10 and contacting points of the guide block 31 and guide roller 29 with respect to the upstanding wall 13 is sufficiently long, the contacting force at these contacting points can be small. As a consequence, the auxiliary rail 20 can move smoothly along the main rail 10 without receiving a large frictional resistance, thereby enabling to guide the flipper door 4 smoothly inwardly. It should be noted that the dead weight of the flipper door 4 can be received by the support roller 15 as shown in FIG. 7B.

Figure 7C:
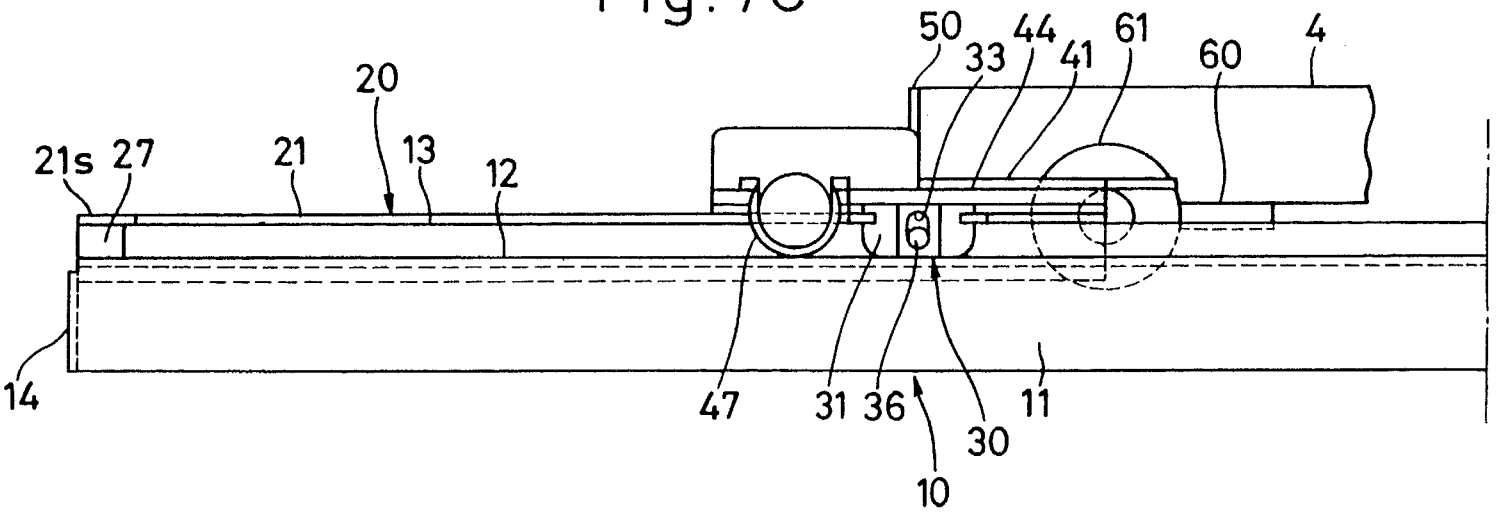
Figure 7D:
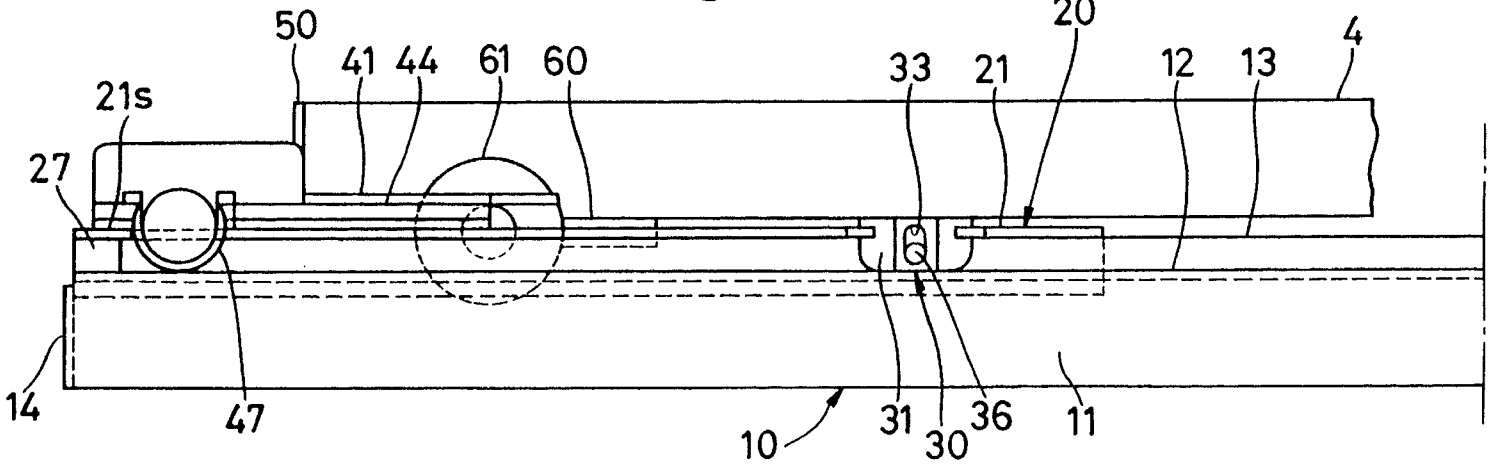
Figure 8B:
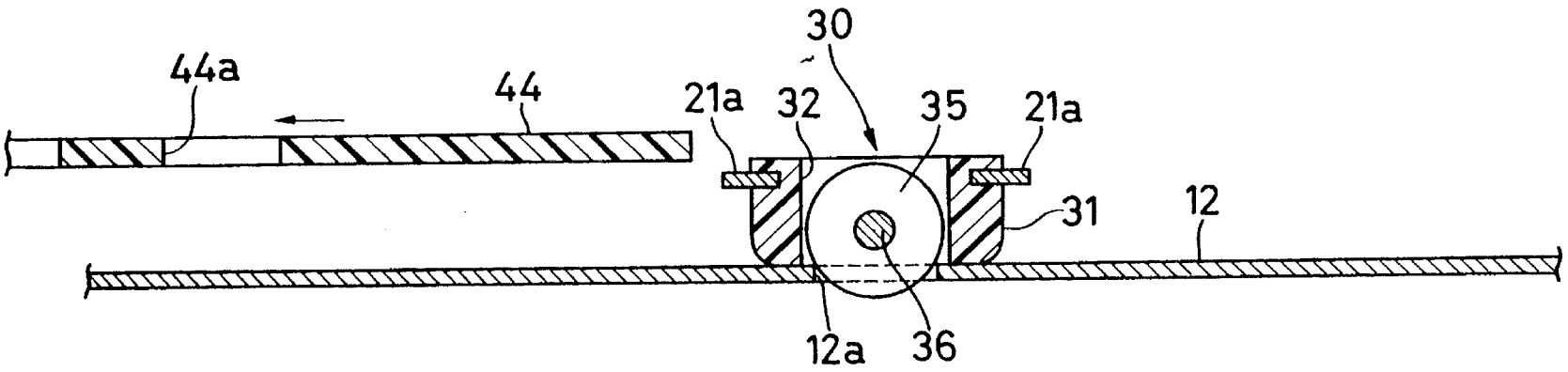
Figure 9:
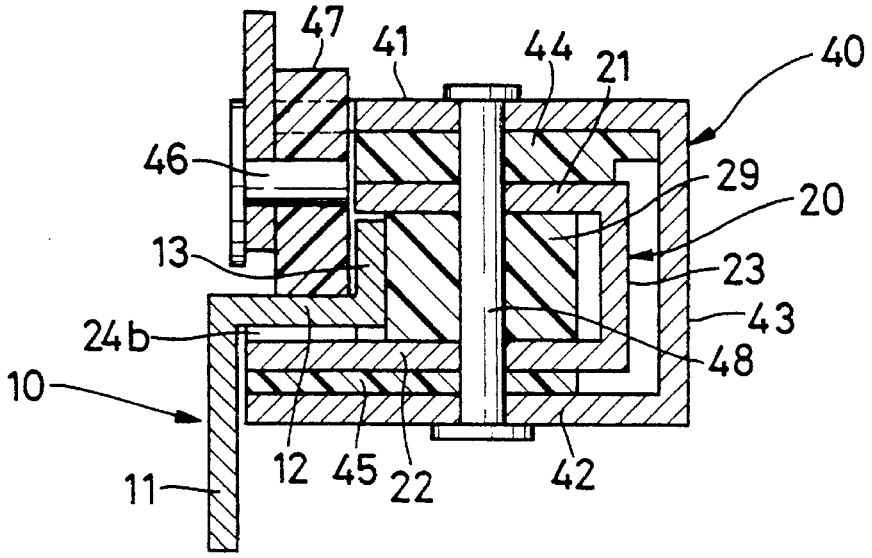
FIG. 9 is an enlarged sectional view taken on line IX—IX of FIG. 3.

In the manner mentioned above, the flipper door 4, the slider 40 and the auxiliary rail 20 are moved into the inner space 2 of the cabinet body 1 together. When the rear end of the auxiliary rail 20 contacts the stopper 14 of the main rail 10 before long as shown in FIG. 7C, the auxiliary rail 20 stops. Just at that moment, as shown in FIG. 8B, the engagement roller 35 of the association mechanism 30 is fallen into the pitfall 12*a* formed in the horizontal wall 12 of the main rail 10 by gravity and the upper portion of the engagement roller 35 is disengaged from the engagement hole 44*a* formed in the guide plate 44 of the slider 40. By this, the association between the slider 40 and the auxiliary rail 20 is removed and the slider 40 can move relative to the auxiliary rail 20. As a consequence, when the flipper door 4 is pushed further inwardly, the slider 40 slides along the auxiliary rail 20 further into the inner space 2 and the roller 47 contacts the stopper 21*s* formed on the auxiliary rail 20 before long. As a result, the slider 40 is stopped. In this way, the flipper door 4 can be guided far into the inner space 2 by the slider 40 which is short in length in the sliding direction. In that state, namely, the flipper door 4 is fully or sufficiently received in the inner space 2, the flipper door 4 is not allowed to project greatly outwardly.

For closing the flipper door 4, first, the flipper door 4 is drawn out of the cabinet body 1. At the first stage, the auxiliary rail 20 remains stopped, but only the slider 40 slides forwardly along the auxiliary rail 20 following the flipper door 4. Before long, the support pin 48 of the slider 40 contacts the front end of the guide slits 21*x* and 22*x* of the auxiliary rail 20 to pull the auxiliary rail 20 forwardly. By this, the auxiliary rail 20 moves forwardly, and the engagement roller 35 comes out of the pitfall 12*a*, allowing the upper portion of the engagement roller 35 to be engaged again in the engagement hole 44*a* formed in the slider 40. As a consequence, the slider 40 and the auxiliary rail 20 moves forwardly together following the flipper door 4. Before long, the guide block 31 of the auxiliary rail 20 contacts the support roller 15 of the main rail 10 to stop the auxiliary rail 20 and flipper door 4 so that they are prevented from escaping from the cabinet body 1. In that state, the flipper door 4 is rotated ninety (90) degrees to close the front opening 3 of the cabinet body 1.

Other embodiments of the present invention will now be described. Component parts corresponding to those of the above embodiment are represented by like reference numerals and detailed description thereof is omitted.

Figure 10:
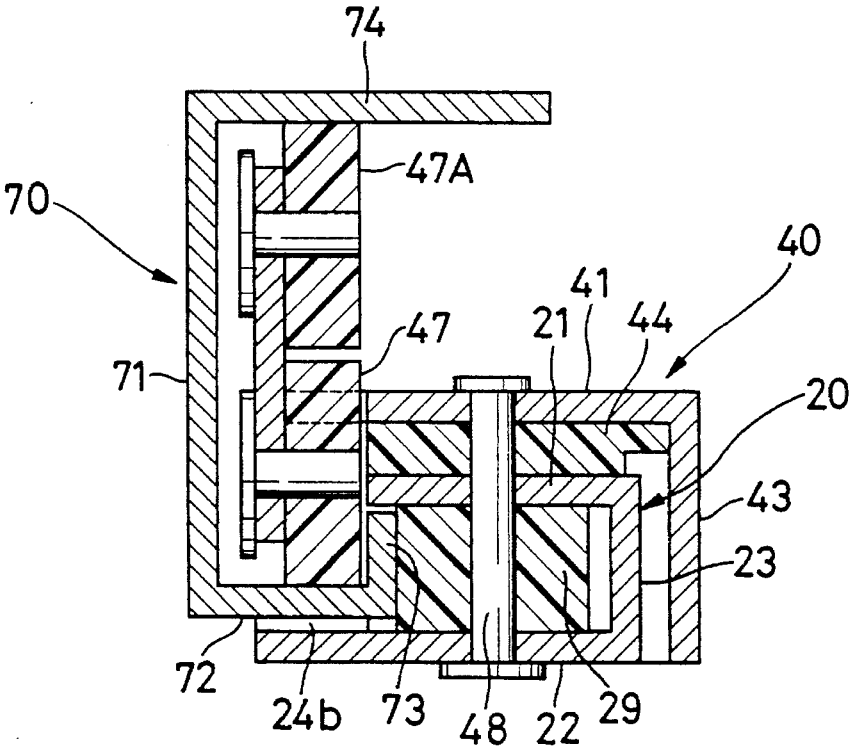
FIG. 10 is an enlarged sectional view, like FIG. 9, but showing a modified example of the guide device.

In the embodiment depicted in FIG. 10, a main rail 70 includes a vertical base wall 71, a horizontal wall 72 extending horizontally from a lower edge of the base wall 71, and an upstanding wall 73 upstanding vertically from a leading edge of the horizontal wall 72. In addition, the main rail 70 includes another horizontal wall 74 extending horizontally from an upper edge of the base wall 71. The horizontal wall 72 and upstanding wall 73 have the same functions as the horizontal wall 12 and upstanding wall 13 of the above embodiment. A roller 47 contacting the horizontal wall 72, like the above embodiment, is rotatably mounted on the slider 40. In addition, another roller 47A is rotatably mounted on the slider 40. This additional roller 47A contacts the horizontal wall 74. The rollers 47 and 47A are mutually offset in the longitudinal direction of the main rail 70. In this embodiment, a lower horizontal wall of the slider 40 is omitted.

Figure 11:
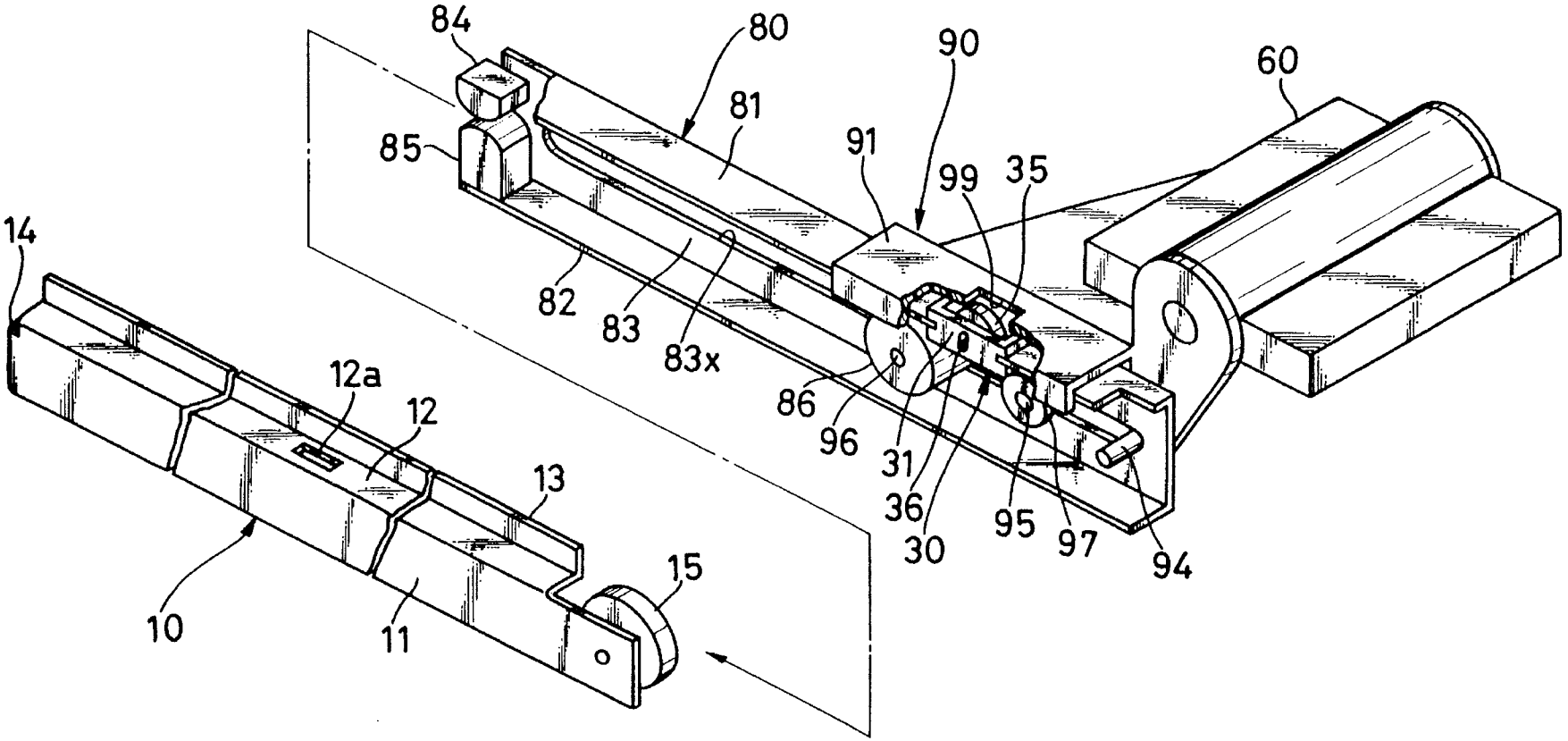
FIG. 11 is an exploded perspective view, like FIG. 4, but showing another modified example of the guide device.

In the embodiment depicted in FIG. 11, an auxiliary rail 80 includes an upper horizontal wall 80, a lower horizontal wall 82, and a vertical wall 83. The horizontal walls 81 and 82 are provided at rear end portions thereof with guide blocks 84 and 85 formed of resin of a small frictional resistance, respectively. A guide block 31 of an association mechanism 30 is mounted on the upper horizontal wall 81 generally at a front end thereof. A guide slit 83*x* extending longitudinally of the auxiliary rail 80 is formed in the vertical wall 83. A guide roller 86 as later described is arranged in such a manner as to be movable along the guide slit 83*x*.

The auxiliary rail 80 is slidably supported on the main rail 10 in the following manner. The horizontal wall 12 of the main rail 10 is slightly loosely inserted between the guide blocks 84 and 85 and loaded on the guide roller 86. Similarly, the upstanding wall 13 of the main rail 10 is slightly loosely inserted between the upper guide block 84 and the vertical wall 83 and also slightly loosely inserted between the vertical wall 13 and the guide block 31.

A slider 90 includes an upper horizontal wall 91, a lower horizontal wall (not shown), and a vertical wall (not shown). The auxiliary rail 80 is received between the upper horizontal wall 91 and the lower horizontal wall. Provided on the vertical wall of the slider 90 are an engagement pin 94 to be inserted in the guide slit 83*x* of the auxiliary rail 80, and two shafts 95 and 96, which are all arranged in the extending direction of the guide slit 83. Since the engagement pin 94 contacts a front end of the guide slit 83*x*, the auxiliary rail 80 follows the slider 90 when the flipper door is withdrawn. Similarly, since the engagement pin 94 contacts the support roller 15 of the main rail 10, the auxiliary rail 80, the slider 90 and the flipper door are prevented from escaping.

A circular plate 97 having a larger diameter than that of the shaft 95 is secured to a distal end portion of the shaft 95, whereas the afore-mentioned guide roller 86 is rotatably mounted on a distal end portion of the shaft 96. Owing to a provision of the circular plate 97 and guide roller 86, the slider 90 is prevented from escaping from the auxiliary rail 80.

In this embodiment, an engagement hole 99 for allowing the engagement roller 35 of the association mechanism 30 to engage therein is formed in the upper horizontal wall 91 of the slider 90.

It should be appreciated that the present invention is not limited to the above embodiments and it can be appropriately modified without departing from the gist of the invention. The flipper door may be rotatable about a vertical axis. Also, the engagement roller may be biased toward the main rail by a spring instead of gravity.

What is claimed is:

1. A guide device for guiding a flipper door into an interior area of a cabinet which includes a cabinet body having a front opening and a flipper door for opening and closing said front opening, said guide device comprising:

(a) a pair of main rails disposed on said cabinet body, said main rails being in a spaced parallel relation with each other and extending in a direction inwardly of said cabinet body generally from a peripheral edge of said front opening;

(b) a pair of auxiliary rails slidably supported respectively on said pair of main rails, said auxiliary rails extending in the same direction as said main rails but shorter in length than said main rails;

(c) a pair of sliders slidably supported respectively on said pair of auxiliary rails, said sliders being shorter in length in a sliding direction thereof than said auxiliary rails, two corner portions of said flipper door being rotatably supported respectively on said pair of sliders; and (d) association means for associating said auxiliary rails with corresponding said sliders when said flipper door in an open position is pushed inwardly of said cabinet body along said main rails, so as to be prohibited from sliding relative to said auxiliary rails, thereby allowing said auxiliary rails and sliders to be slid along said main rails together;

(e) said association means removing the association between said auxiliary rails and said sliders when said auxiliary rails have reached substantially innermost end portions of said main rails, respectively, thereby enabling said sliders to slide inwardly of said cabinet body along said auxiliary rails.

2. A guide device according to claim 1, in which said association means includes an engagement member supported on each of said auxiliary rails for movement in a direction perpendicular to said auxiliary rails and biased toward said main rails, and an engagement hole formed in each of said sliders, each said engagement member being in contact with a surface of a respective main rail and being partly engaged in a respective said engagement hole, thereby associating said auxiliary rails and said sliders with each other, a pitfall being formed in each said surface of said main rail, so that when said auxiliary rails have reached a substantially innermost end portion of said main rails, said engagement members fall in said pitfalls and disengage from said engagement holes, thereby removing the association between said auxiliary rails and said sliders.

3. A guide device according to claim 2, in which a block is mounted on each of said auxiliary rails, a receiving hole being formed in said block, an elongate hole being formed in each of a pair of walls sandwiching said receiving hole, said elongate hole extending in a direction perpendicular to said auxiliary rails, said engagement members each being formed of a roller and received in each of said receiving holes, a shaft extending through said roller, opposite ends of said shaft being received in said elongate holes, respectively.

4. A guide device according to claim 3, in which said roller is biased toward each of said main rails by gravity.

* * * * *